US006880340B2

(12) United States Patent
Saitoh

(10) Patent No.: US 6,880,340 B2
(45) Date of Patent: Apr. 19, 2005

(54) COMBUSTOR WITH TURBULENCE PRODUCING DEVICE

(75) Inventor: Keijiro Saitoh, Hyogo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/343,743

(22) PCT Filed: Jun. 7, 2002

(86) PCT No.: PCT/JP02/05710

§ 371 (c)(1),
(2), (4) Date: Feb. 6, 2003

(87) PCT Pub. No.: WO02/101294

PCT Pub. Date: Dec. 19, 2002

(65) Prior Publication Data

US 2003/0110774 A1 Jun. 19, 2003

(30) Foreign Application Priority Data

Jun. 7, 2001 (JP) ..... 2001-173006

(51) Int. Cl.[7] ..... F02C 1/00

(52) U.S. Cl. ..... 60/737; 60/740; 60/746; 60/748

(58) Field of Search ..... 60/737, 740, 746, 60/747, 748

(56) References Cited

U.S. PATENT DOCUMENTS 5,609,017 A * 3/1997 Althaus ..... 60/778
6,158,223 A * 12/2000 Mandai et al. ..... 60/737

FOREIGN PATENT DOCUMENTS

| | | |
|---|---|---|
| JP | 64-38523 | 2/1989 |
| JP | 5-332512 | 12/1993 |
| JP | 7-91661 | 4/1995 |
| JP | 8-82419 | 3/1996 |
| JP | 8-145361 | 6/1996 |
| JP | 8-226649 | 9/1996 |

* cited by examiner

*Primary Examiner*—Charles G. Freay
(74) *Attorney, Agent, or Firm*—Oblon, Spivak, McClelland, Maier & Neustadt, P.C.

(57) ABSTRACT

The present invention relates to a gas turbine combustor comprising an air passage to supply air to the inside; and a fuel nozzle which is provided with an injection port to inject fuel and disposed in the air passage, wherein a turbulence producing means adjacent to the injection port of the fuel nozzle is provided in the air passage. Further, the present invention relates to a gas turbine combustor comprising an air passage to supply air to the inside; and a fuel nozzle which is provided with an injection port to inject fuel and disposed in the air passage, wherein a diffuser portion is provided in the air passage, and the diffuser portion causes the cross-sectional area of a part of the air passage positioned in the vicinity of the injection port to be smaller than that of a downstream portion of the air passage positioned downstream from the injection port in the direction of the airflow. Thus, the mixing action of fuel and air can be enhanced, and combustion vibration can be prevented.

14 Claims, 13 Drawing Sheets

COMBUSTOR WITH TURBULENCE PRODUCING DEVICE

TECHNICAL FIELD

The present invention relates to a combustor, and particularly, to a gas turbine combustor used for a gas turbine.

BACKGROUND ART

FIG. 13 shows a longitudinal sectional view of a prior art and is the combustor containing a fuel nozzle disclosed in Japanese Unexamined Patent Publication (Kokai) No. 6-2848. As shown in FIG. 13, a pilot nozzle 300 is provided on a center axis of an inner tube 180 of a combustor 100. A plurality of fuel nozzles 200 which extend substantially in parallel with the pilot nozzle 300 are equally spaced in a circumferential direction around the pilot nozzle 300. Fuel is supplied to the pilot nozzle 300 and fuel nozzles 200. A swirl vane or a swirler 290 is disposed around a rodlike body of the fuel nozzle 200. A plurality of hollow columns 250 which radially and outwardly extend from the sidewall of the fuel nozzle 200 are provided on the fuel nozzle 200. The hollow columns 250 are connected to the fuel nozzle 200. A plurality of injection ports 260 are provided in each hollow column 250 to inject fuel toward a tip end of the fuel nozzle 200. A mixing chamber 150 is formed in the vicinity of the tip end of the fuel nozzle 200, and a pilot combustion chamber 160 is defined by a pre-mixing nozzle 170 in the vicinity of the tip end of the pilot nozzle 300.

Air for combustion that enters the combustor 100 through an air inlet 110 thereof is reversed through about 180° at an inner tube end portion 120 and flows into an air passage 140. A part of the air for combustion is mixed with fuel injected from injection ports 260 of the hollow column 250 and, then flows into the swirler 290 of the fuel nozzle 200. Accordingly, the air for combustion is mainly turned in a circumferential direction, and mixing of the air for combustion and the fuel is promoted. Thus, pre-mixed air is produced in the mixing chamber 150.

The remaining air for combustion flows into the swirler 390 disposed between the pilot nozzle 300 and the pre-mixing nozzle 170. The air for combustion is burnt with fuel injected from the tip end of the pilot nozzle 300, in the pilot combustion chamber 160, to produce a pilot flame. Pre-mixed air mixed with fuel injected form the injection ports 260 of the hollow column 250 is brought into contact with the pilot flame and then is burnt to produce a main flame.

In the combustor disclosed in Japanese Unexamined Patent Publication (Kokai) No. 6-2848, fuel is injected from the hollow column having a fuel injection port so that the fuel is uniformly mixed with air. In order to enhance a mixing action, increasing the number of injection ports per one hollow column 250 and increasing the number of hollow columns 250 has been considered. However, the number of the hollow columns and the number of injection ports are physically limited and, thus, the enhancement of the mixing action is limited. In general, the occurrence of $NO_x$ tends to increase as the ratio of fuel to combustion air is increased, i.e., a hot spot occurs. Therefore, it is preferable that fuel be uniformly mixed with air.

In the pre-mix type combustor disclosed in Japanese Unexamined Patent Publication (Kokai) No. 6-2848, the spatial density of energy released by combustion is increased when the combustion is carried out in a relatively narrow space. Consequently, combustion vibration occurs.

The combustion vibration is associated with a columnar resonance, and is determined by the length, capacity and flow resistance of the combustor. In this case, the concentration of fuel varies due to velocity fluctuations in the pre-mixing nozzle 170 and, then, the combustion vibration, a self-excited vibration phenomenon, occurs. The combustion becomes unstable due to the combustion vibration, and the combustor cannot be driven stably. Therefore, it is necessary to prevent the occurrence of combustion vibration.

Japanese Patent Application No. 2000-220832 discloses a combustor nozzle in which a velocity fluctuation absorbing member is provided in an inlet portion to take air therein so as to prevent the occurrence of the combustion vibration. In this prior art, the velocity fluctuation absorbing member produces a flow resistance to absorb the velocity fluctuation resulting from the combustion vibration, and thus the occurrence of the combustion vibration is prevented.

However, in the combustor disclosed in Japanese Patent Application No. 2000-220832, the air passes through the velocity fluctuation absorbing member positioned in the inlet portion and is reversed by about 180° at an inner tube end portion and, then, flows toward the swirler and the mixing chamber. Namely, in the above-described Japanese Patent Application No. 2000-220832, a distance between the velocity fluctuation absorbing member and the mixing chamber is relatively long. Therefore, there is a possibility that an air turbulence occurred by the velocity fluctuation absorbing member in the inlet portion is decreased in the vicinity of the mixing chamber, or completely disappears in the vicinity of the mixing chamber. The installation of the velocity fluctuation absorbing member of the combustor disclosed in Japanese Patent Application No. 2000-220832 is strictly for the purpose of control of the combustion vibration, and a mixing action resulting from the turbulence is not taken into consideration. Therefore, it is necessary to maintain the turbulence of the airflow when the mixture of fuel and air is enhanced by the turbulence.

In the above-described combustor disclosed in Japanese Unexamined Patent Publication (Kokai) No. 6-2848, there is a limit to an increase in the number of injection ports because the diameter of the injection port of the hollow column is determined depending on a machining accuracy or a problem of hole clogging. Further, when the number of hollow columns is increased, it is difficult to supply air to the mixing chamber because the hollow columns 250 interrupt the airflow. Therefore, a method for enhancing a mixing action of fuel and air without increasing the number of the hollow columns and the injection ports of the hollow column is demanded.

In the velocity fluctuation absorbing member positioned in the air inlet portion disclosed in Japanese Patent Application No. 2000-220832, it is assumed that the combustion vibration cannot be effectively reduced under the influence of the capacity of air existing between the air inlet portion and a pre-mixer. Accordingly, a more effective combustion vibration reducing structure, which is hardly influenced by the capacity on the upstream side of the pre-mixer, is required.

Therefore, the object of the present invention is to provide a gas turbine combustor in which the occurrence of the combustion vibration is prevented while the mixing action of fuel and air is enhanced.

DISCLOSURE OF THE INVENTION

According to a first embodiment of the present invention, there is provided a gas turbine combustor comprising an air passage to supply air to the inside; and a fuel nozzle which is provided with an injection port to inject fuel and is disposed in the air passage, wherein a turbulence producing means is provided in the air passage to produce turbulence in the vicinity of the injection port of the fuel nozzle.

Namely, according to the first embodiment of the present invention, a turbulence producing body produces turbulence in the airflow in the vicinity of the fuel injection port. Accordingly, the air can be mixed with fuel while the air turbulence is maintained. Therefore, the mixing action of fuel and air can be enhanced. The occurrence of a hot spot is prevented by uniformly mixing air with fuel, and thus the occurrence of $NO_x$ can be prevented. Further, the turbulence producing body also functions as a pressure losing body. Accordingly, the velocity fluctuation in the combustion vibration can be absorbed by producing the flow resistance. Thus, the influences of the capacity of air and the length of an air column positioned upstream of the turbulence producing body are reduced, and the amplitude of the velocity fluctuation is decreased in the pre-mixing nozzle. Therefore, concentration fluctuations of fuel is decreased in the pre-mixing nozzle, and the occurrence of the combustion vibration is prevented.

BEST MODE FOR CARRYING OUT THE INVENTION

Figure 1:
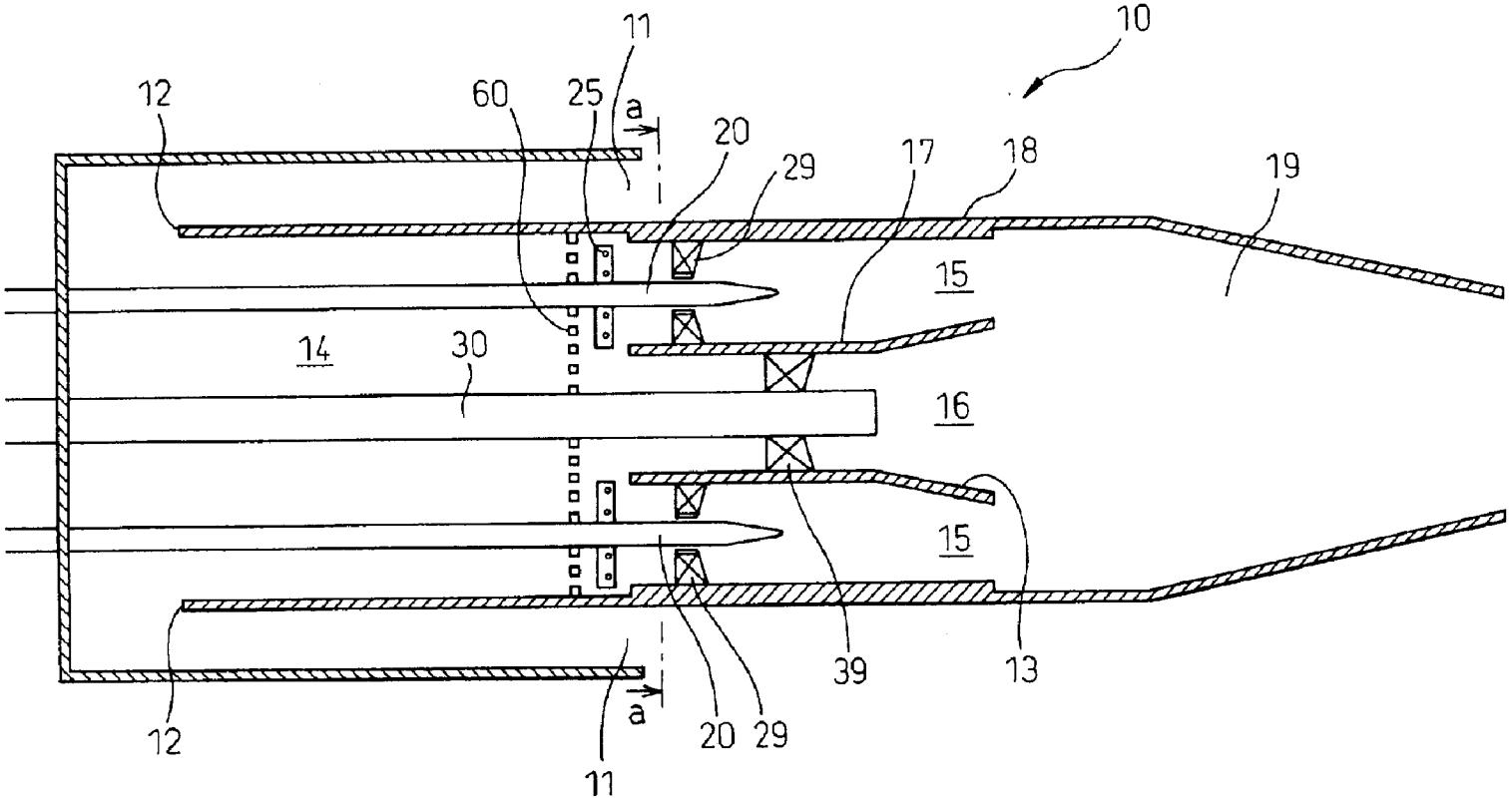
FIG. 1 is a longitudinal partially sectional view of combustor according to a first embodiment of the present invention.

Embodiments of the present invention will be described below with reference to the accompanying drawings. In the drawings, same members are designated by same reference numerals. The scale of these drawings is changed for easy understanding.

Figure 2:
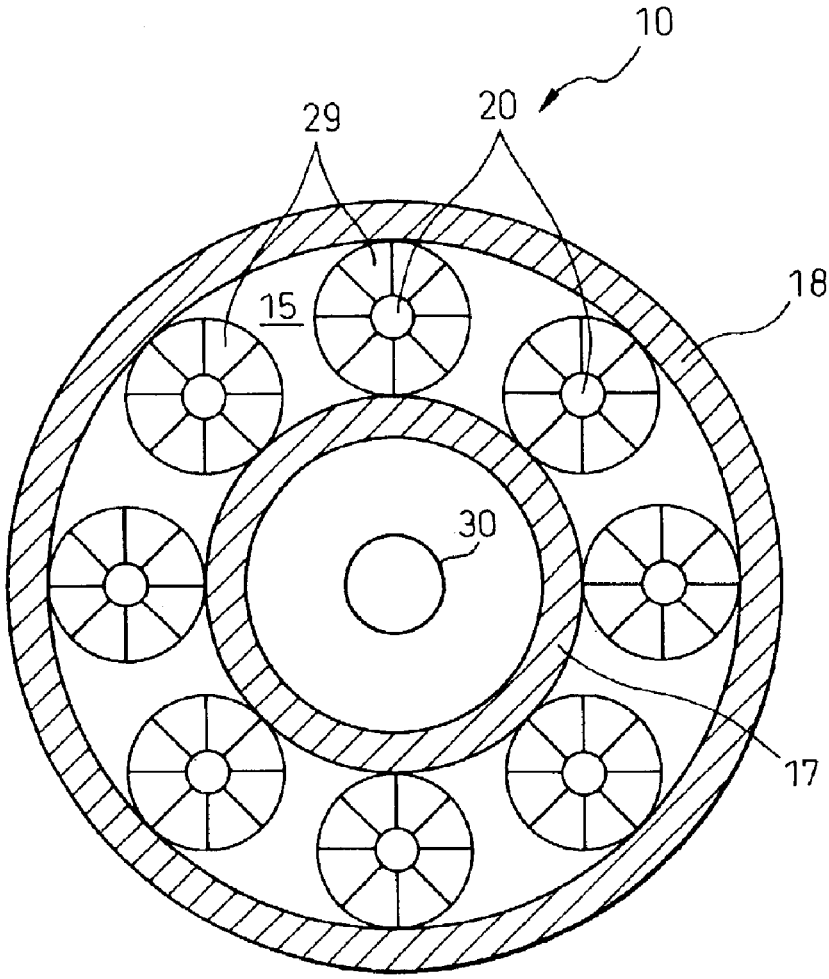
FIG. 2 is a sectional view taken along the line a—a in FIG. 1.

FIG. 1 shows a longitudinal partially sectional view of a combustor according to a first embodiment of the present invention. FIG. 2 is a sectional view taken along the line a—a in FIG. 1. Similar to the above-described embodiment, a pilot nozzle 30 is provided on a center axis of an inner tube 18 of a combustor 10. As can be seen from FIG. 2, a plurality of fuel nozzles 20 are equally spaced in a circumferential direction around the pilot nozzle 30. A swirl vane or a swirler 29 is disposed around a rodlike body of the fuel nozzle 20. A plurality of hollow columns 25 are provided on the fuel nozzle 20. The hollow columns 25 radially and outwardly extend from the sidewall of the fuel nozzle, and are connected to the fuel nozzle 20. A plurality of injection ports 26 are provided in each hollow column 25 so that the fuel that flows through the fuel nozzle 20 is introduced into the hollow column 25 and, then, is injected from these injection ports toward a tip end of the fuel nozzle. Further, a mixing chamber 15 is formed in the vicinity of the tip end of the fuel nozzle 20, and a pilot combustion chamber 16 is defined by a pre-mixing nozzle 17 in the vicinity of the tip end of the pilot nozzle 30.

Air for combustion that enters the combustor 10 through an air inlet 11 thereof is reversed by about 180° at an inner tube end portion 12 to pass through an air passage 14. A part of air for combustion is mixed with fuel injected from the hollow column 25 and, then, flows into the swirler 29 of the fuel nozzle 20. Accordingly, the air for combustion is mainly turned in a circumferential direction, and mixture of the air for combustion and the fuel is promoted. Thus, pre-mixed air is produced in the mixing chamber 15.

The remaining of air for combustion flows into the swirler 39 disposed between the pilot nozzle 30 and the pre-mixing nozzle 17. The air for combustion is burnt with fuel injected from the pilot nozzle 30, in the pilot combustion chamber 16, to produce a pilot flame. Pre-mixed air mixed with fuel injected form the hollow column 25 is brought into contact with the pilot flame and then is burnt to produce a main flame.

Figure 3:
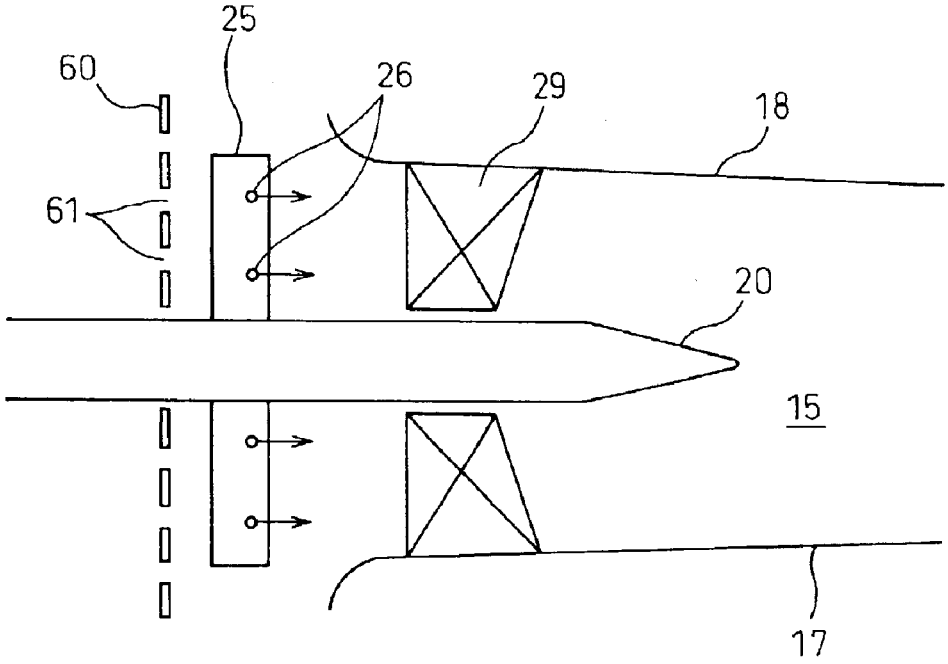
FIG. 3 is an enlarged view of surroundings of a fuel nozzle of a combustor according to a first embodiment of the present invention.
Figure 4A:
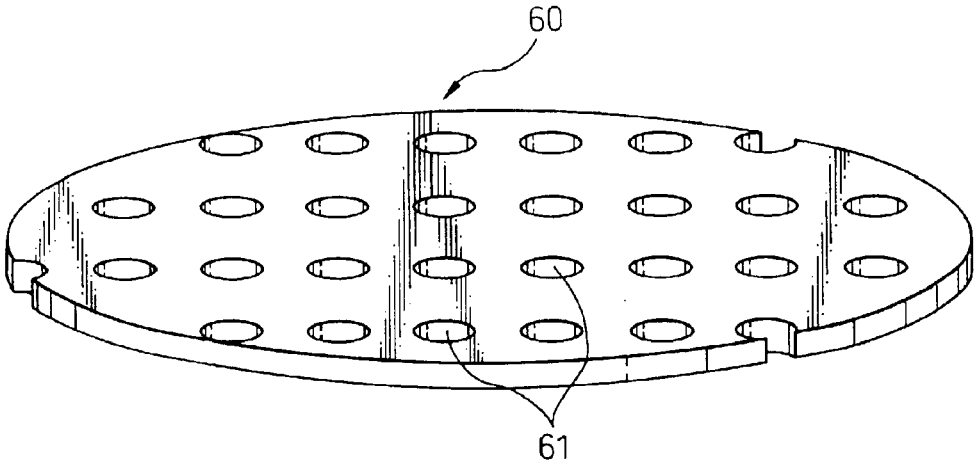
FIG. 4*a* is a conceptual perspective view of a porous plate.
Figure 4B:
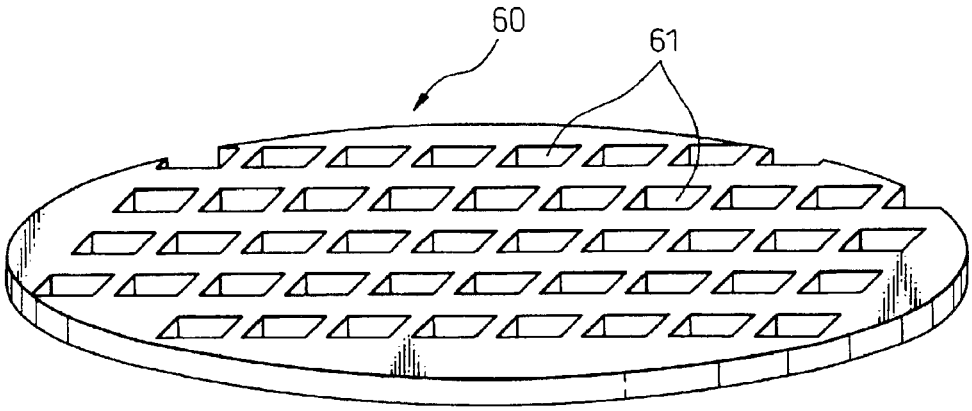
FIG. 4*b* is a conceptual perspective view of a porous plate.

FIG. 3 is an enlarged view of surroundings of a fuel nozzle of a combustor according to a first embodiment of the present invention. As shown in FIG. 1 and FIG. 3, in the present embodiment, a turbulence producing body 60 is disposed adjacent to the hollow column 25 on the upstream side of the hollow column 25 in the direction of the airflow. The turbulence producing body 60 is, for example, a porous plate made of metal having a plurality of holes, i.e., a punching metal. FIG. 4*a* and FIG. 4*b* are conceptual perspective views of the porous plate 60. As shown in these drawings, a plurality of holes 61 are provided in the porous plate 60, and the air passes through these holes. The hole 61 shaped like a circle is shown in FIG. 4*a*, and the hole 61 shaped like a rectangle is shown in FIG. 4*b*.

As described above, the air that enters the combustor 10 through the air inlet 11 is reversed by about 180° at the inner tube end portion 12 to pass through the porous plate 60 in the air passage 14. The cross-sectional area of the airflow is rapidly decreased and, then is rapidly increased when the air passes through the holes 61 of the porous plate 60. The irregularity of the airflow, i.e., turbulence occurs when the cross-sectional area is rapidly increased. Such turbulence is maintained even after the air passes through the hollow column 25 positioned downstream from the porous plate 60. Therefore, the mixing action of the air and the fuel injected from the injection port 26 of the hollow column 25 can be enhanced by the porous plate 60. Further, the porous plate 60 also functions as the pressure losing body. Accordingly, the velocity fluctuation of the combustion vibration can be absorbed by producing the flow resistance. Thus, the influences of the capacity of air and the length of the air column positioned upstream from the turbulence producing body are reduced, and the amplitude of the velocity fluctuation in the pre-mixing nozzle is decreased. Therefore, the concentration fluctuation of fuel in the pre-mixing nozzle is decreased, so that the occurrence of the combustion vibration can be prevented.

Figure 5A:
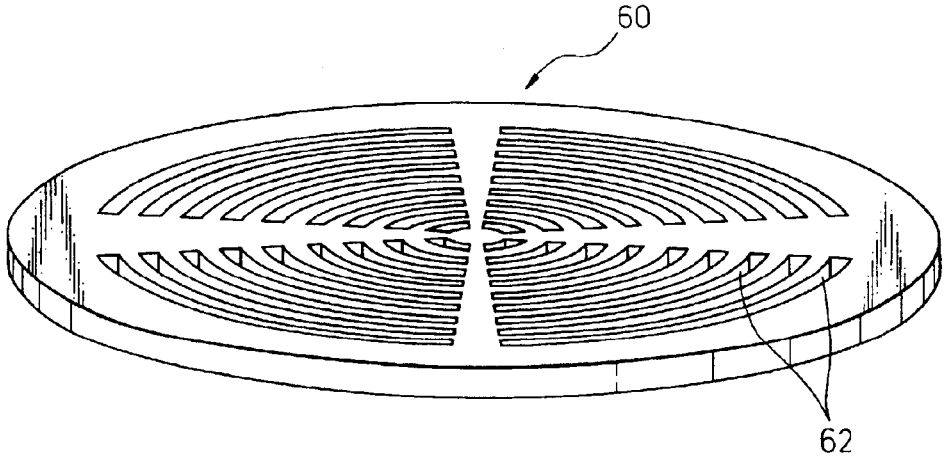
FIG. 5*a* is a conceptual perspective view of a porous plate.
Figure 5B:
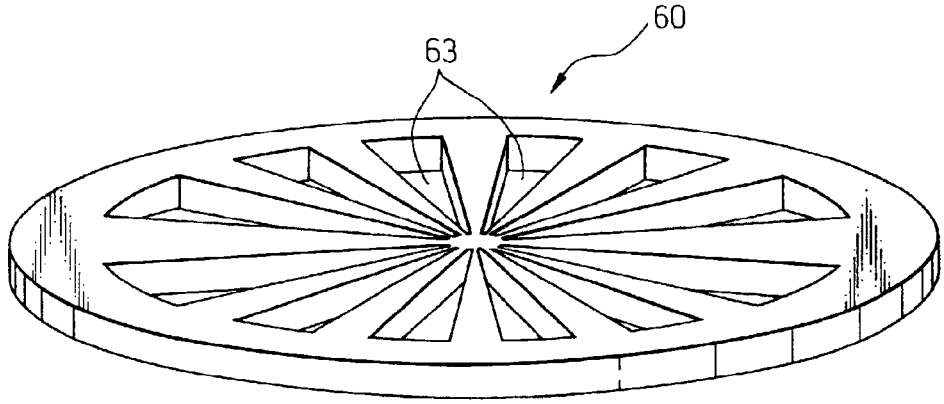
FIG. 5*b* is a conceptual perspective view of a porous plate.

A porous plate made of metal (not shown) as another example in FIG. 4*a*, or a wire netting (not shown) as another example in FIG. 4*b* may be used. Another porous plate is shown in FIG. 5*a* and FIG. 5*b*. Holes formed in the porous plate 60 may be circumferential direction slits 62 shown in FIG. 5*a*, or may be radial direction slits 63 shown in FIG. 5*b*. Even when these examples of the porous plate are used, the turbulence of air passing through holes or slits is produced, so that the mixing action of air and fuel can be enhanced mainly in the radial direction, and the velocity fluctuation of the combustion vibration can be absorbed by producing the flow resistance.

In the present embodiment, the porous plate 60 is disposed upstream from the hollow column 25 to be adjacent to the hollow column 25. However, the porous plate 60 may be disposed downstream from the hollow column 25. Even in this case, the irregularity of airflow occurs downstream from the porous plate 60. Accordingly, the mixing action of fuel and air can be enhanced, and the velocity fluctuation of the combustion vibration can be absorbed.

Figure 6:
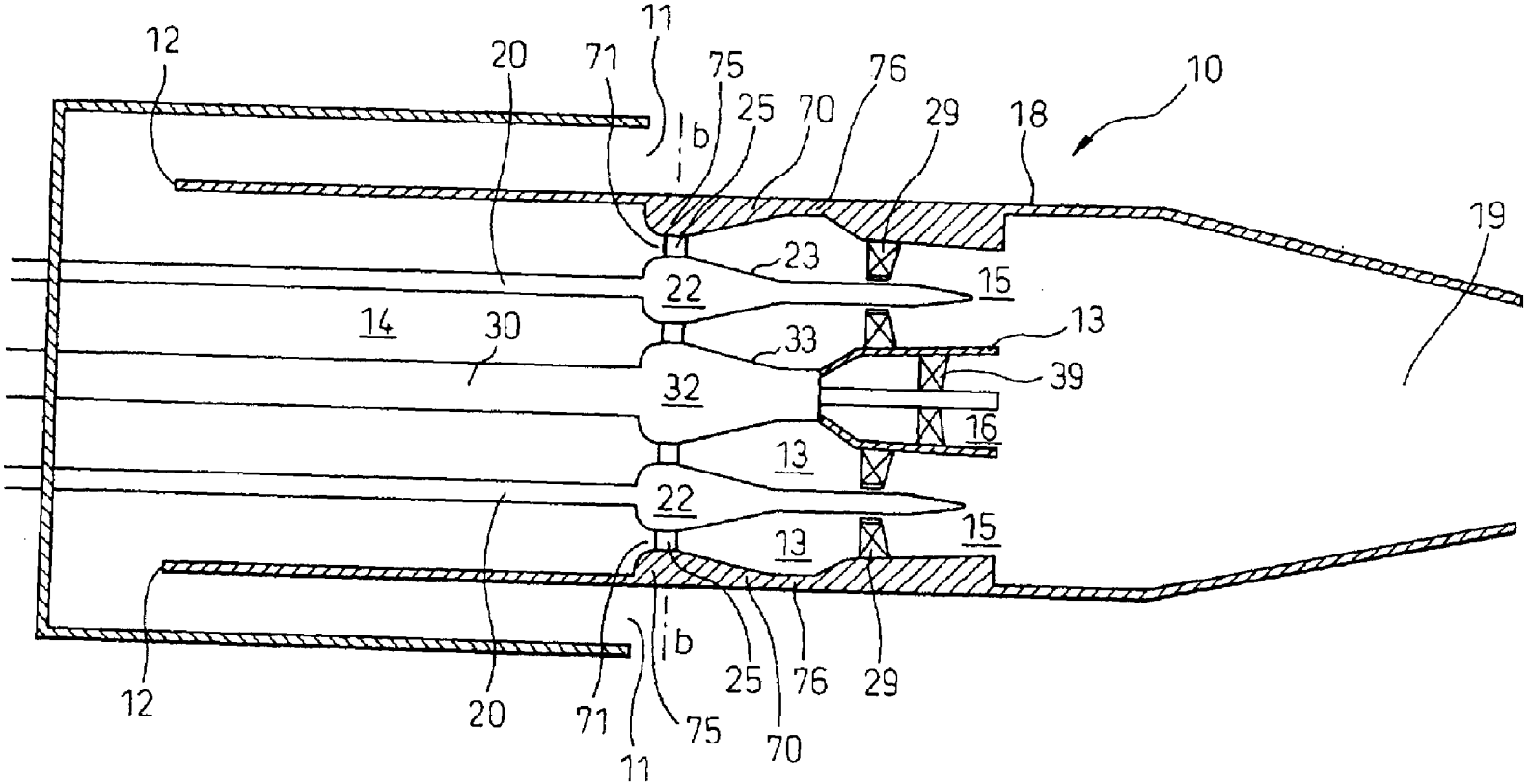
FIG. 6 is a longitudinal partially sectional view of a combustor according to a second embodiment of the present invention.
Figure 7:
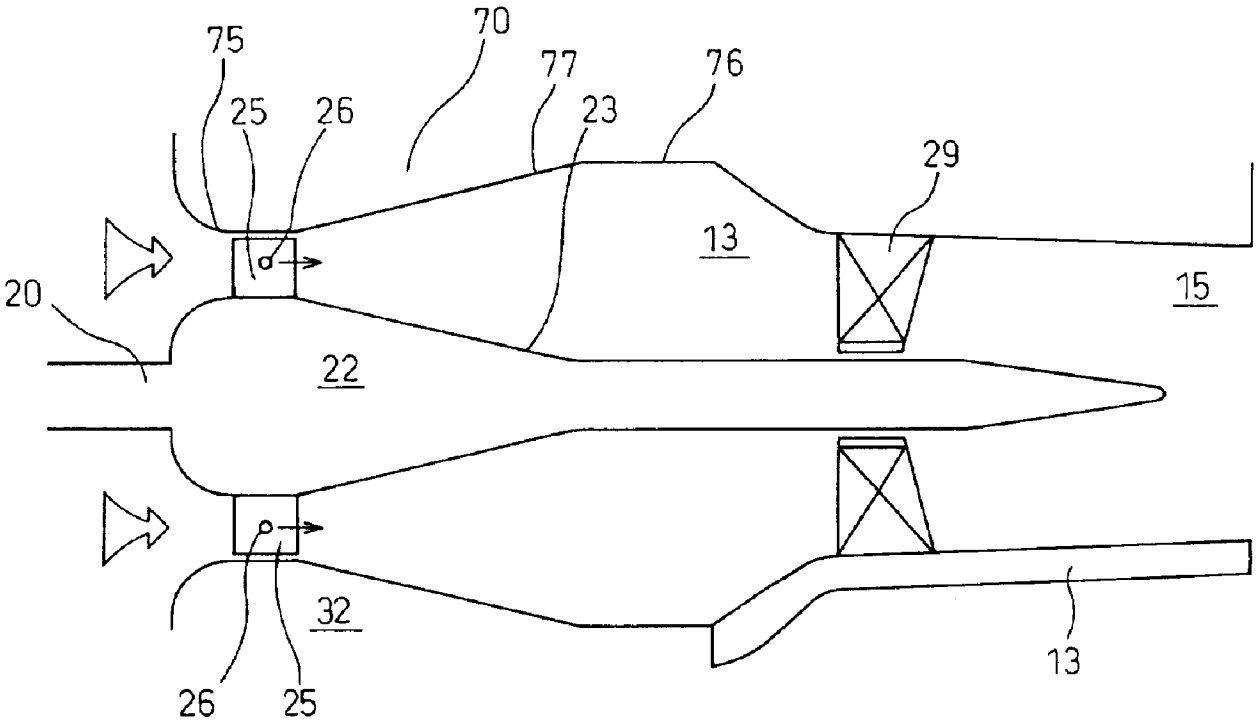
FIG. 7 is an enlarged view of a fuel nozzle of a combustor shown in FIG. 6.
Figure 8:
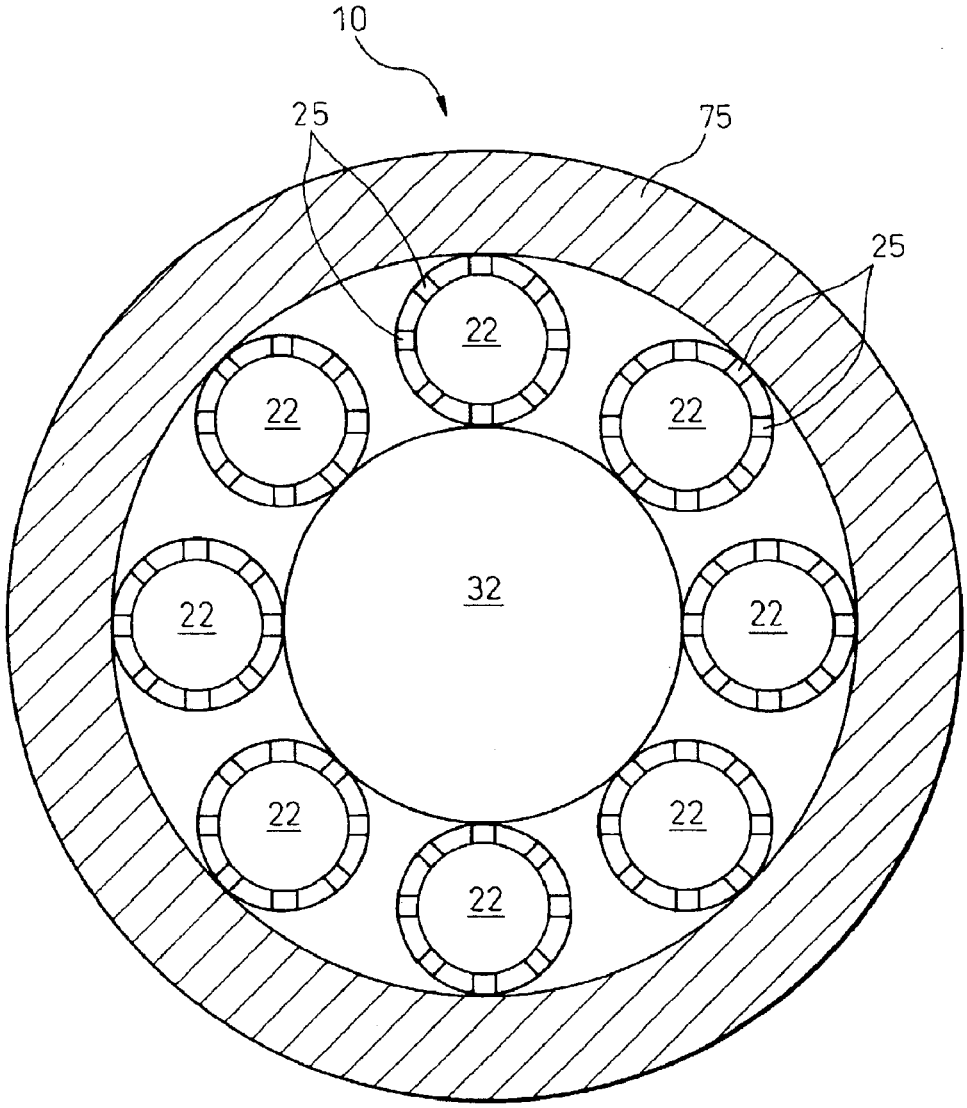
FIG. 8 is a sectional view taken along the line b—b in FIG. 6.

FIG. 6 is a longitudinal direction partially sectional view of a combustor according to a second embodiment of the present invention. FIG. 7 is an enlarged view of a fuel nozzle of a combustor shown in FIG. 6. FIG. 8 is a sectional view taken along the line b—b in FIG. 6. As shown in FIG. 6, a diffuser portion 70 is provided in the inner tube 18 of the combustor 10. The diffuser portion 70 contains a narrow portion 75 that is narrow in the radial direction and a wide portion 76 that is wide in the radial direction, and an inclined portion 77 smoothly connects the narrow portion 75 to the wide portion 76. The fuel nozzle 20 and the pilot nozzle 30 have projections 22, 32, respectively. These projections 22, 32 are substantially shaped like a cone that tapers down in the downstream direction of the airflow, and have inclined portions 23, 33, respectively. As can be seen from FIG. 6, an annular chamber 13 is defined by an inner wall of the diffuser portion 70 and an outer wall of the pilot nozzle 30. The fuel nozzles 20 containing the projection 22 are substantially equally spaced in the circumferential direction in the annular chamber 13.

As shown in FIG. 8, the hollow column 25 is disposed between the narrow portion 75 and the projection 32. Therefore, the air passes through an inlet of the diffuser portion 70, which is narrowest between the narrow portion 75 and the projection 32. The turbulence occurs in the diffuser portion 70 when the air and the fuel injected from the injection port 26 pass through the diffuser portion 70, along the inclined portion 77 and the inclined portions 23, 33. Thus, the mixing action of fuel and air can be promoted in the annular chamber 13. As a matter of course, the diffuser portion 70 is formed so that the velocity component of a main airflow is large enough not to produce a backfire in the diffuser portion 70. It is necessary that the spreading angle of the diffuser is made appropriate, and the pressure loss occurring in the diffuser is made low enough not to reduce the efficiency of the gas turbine.

The turbulence in the diffuser portion 70 is useful to enhance the mixing action of air and fuel mainly in the radial direction. As described above, the swirler 29 has a function to mix air with fuel in the circumferential direction. Therefore, the mixing action in the radial direction mainly occurs in the annular chamber 13 defined by the inner wall of the diffuser portion 70 and the outer wall of the pilot nozzle 30 and, then the mixing action mainly in the circumferential direction occurs in the mixing chamber 15 by the swirler 29. Thus, the air can be extremely uniformly mixed with the fuel.

In the present embodiment, the velocity and the dynamic pressure of air are extremely large in the inlet of the diffuser portion 70. Therefore, when there is the circumferential direction distribution of airflow that enters the diffuser portion 70, the distribution is reduced by the dynamic pressure in the inlet of the diffuser portion 70. Thus, a mixing ratio of air to fuel can be made equal in the circumferential direction in the inlet of the diffuser portion.

Figure 9:
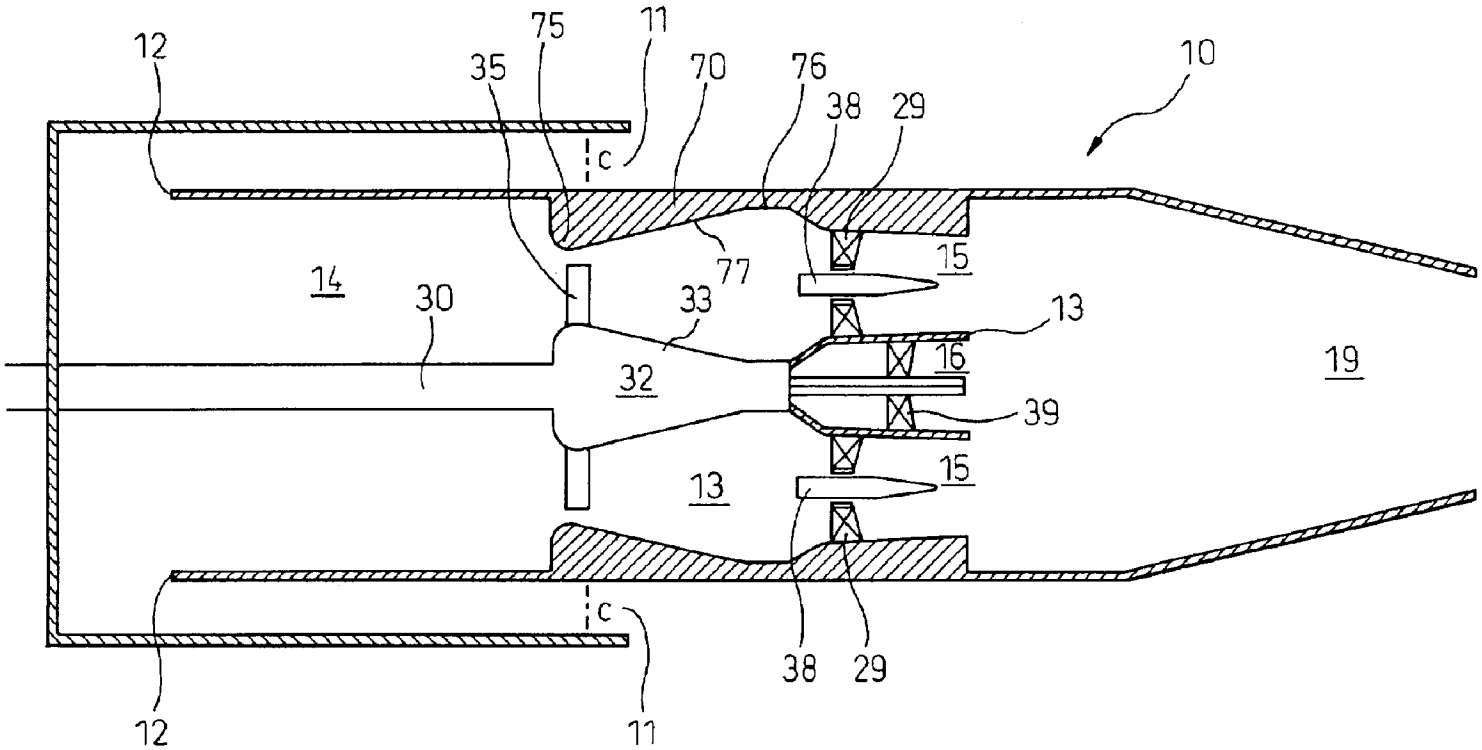
FIG. 9 is a longitudinal partially sectional view of a combustor according to another embodiment of the present invention.
Figure 10:
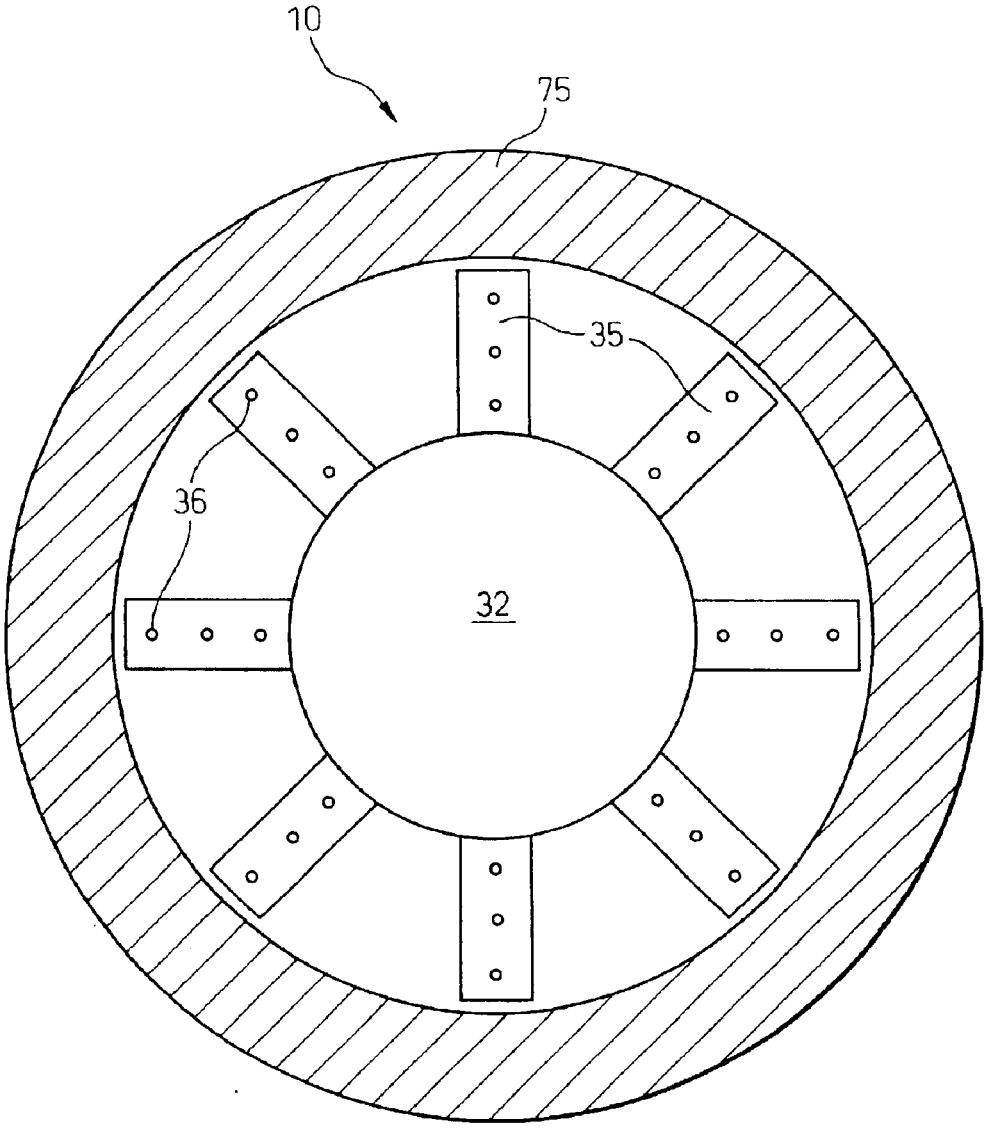
FIG. 10 is a sectional view taken along the line c—c in FIG. 9.

FIG. 9 is a longitudinal direction partially sectional view of a combustor according to another embodiment of the present invention. FIG. 10 is a sectional view taken along the line c—c in FIG. 9. In the present embodiment, a plurality of fuel nozzles 20 are eliminated, and a plurality of hollow columns 35 are provided around the pilot nozzle 30. The plurality of hollow columns 35 radially and outwardly extend from the side wall of the pilot nozzle 30. The hollow columns 35 shown in the present embodiment extend to the vicinity of the narrow portion 75 of the diffuser portion 70. A plurality of injection ports 36 are provided in each of the hollow columns 35. Accordingly, the fuel passing through the pilot nozzle 30 passes through each hollow column 35 and is injected in the downstream direction from the plural injection ports 36. The pilot nozzle 30 has a projection 32. The projection 32 is substantially shaped like a cone, tapers toward a downstream side in the direction of the airflow, and has an inclined portion 33. Similar to the embodiment shown in FIG. 6, the annular chamber 13 is defined by the inner wall of the diffuser portion 70 and the outer wall of the pilot nozzle 30. A shaft 38 is provided to minimize the area of the core of a vortex produced by the swirler 29.

Even in the present embodiment, the mixing action in the radial direction mainly occurs in the annular chamber 13 defined by the inner wall of the diffuser portion 70 and the outer wall of the pilot nozzle 30, and the mixing action in the circumferential direction mainly occurs by the swirler 29 in the mixing chamber 15. In the present embodiment, the fuel nozzle 20 does not become an obstruction because fuel nozzle 20 does not exist. Accordingly, the air can smoothly pass into the annular chamber 13 through the air passage 14. Further, the structure of the combustor 10 can be simplified, and the total weight of the combustor 10 can be reduced because the fuel nozzle 20 does not exist.

Figure 11:
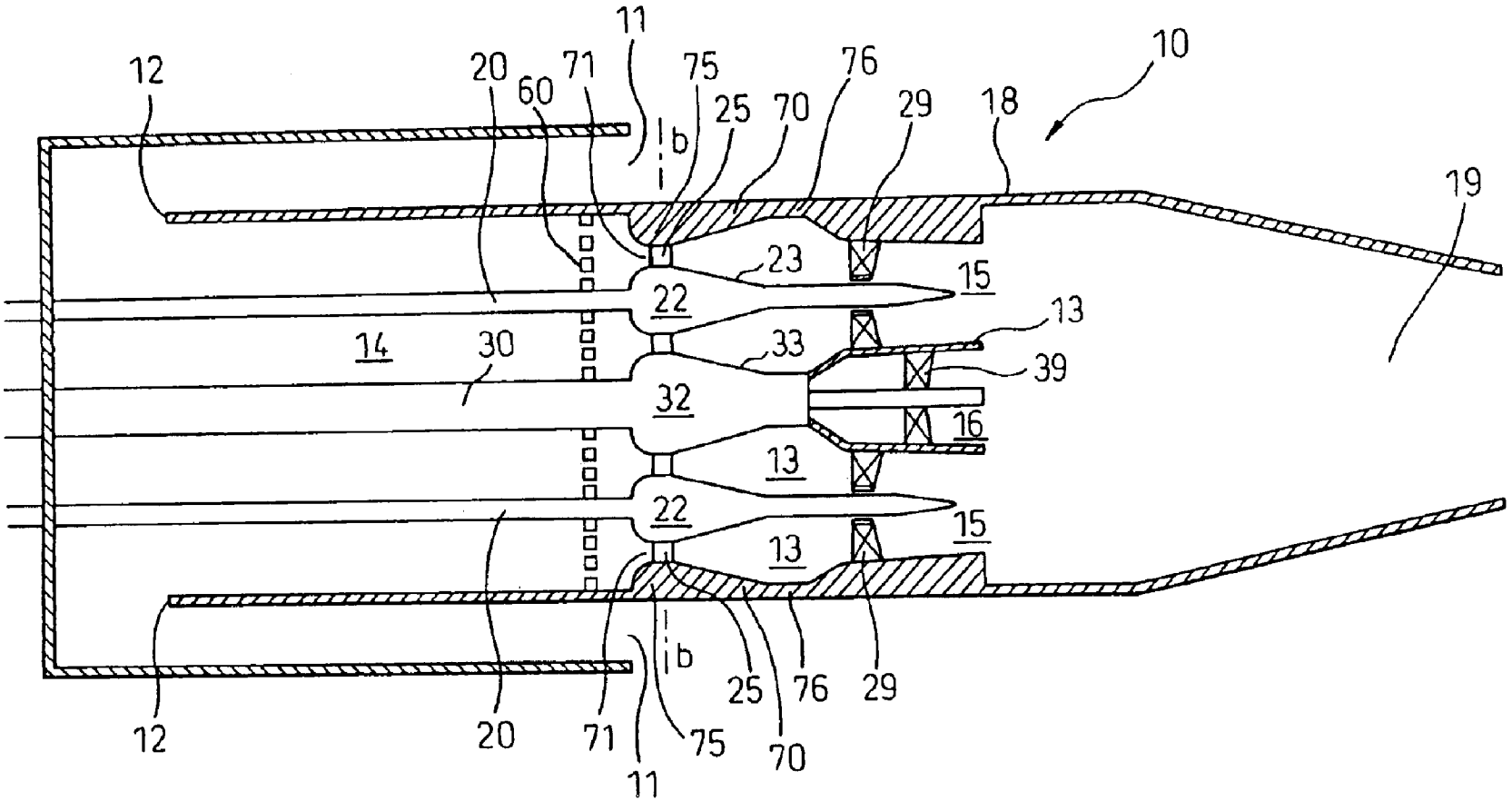
FIG. 11 is a longitudinal partially sectional view of a combustor according to an additional embodiment of the present invention.
Figure 12:
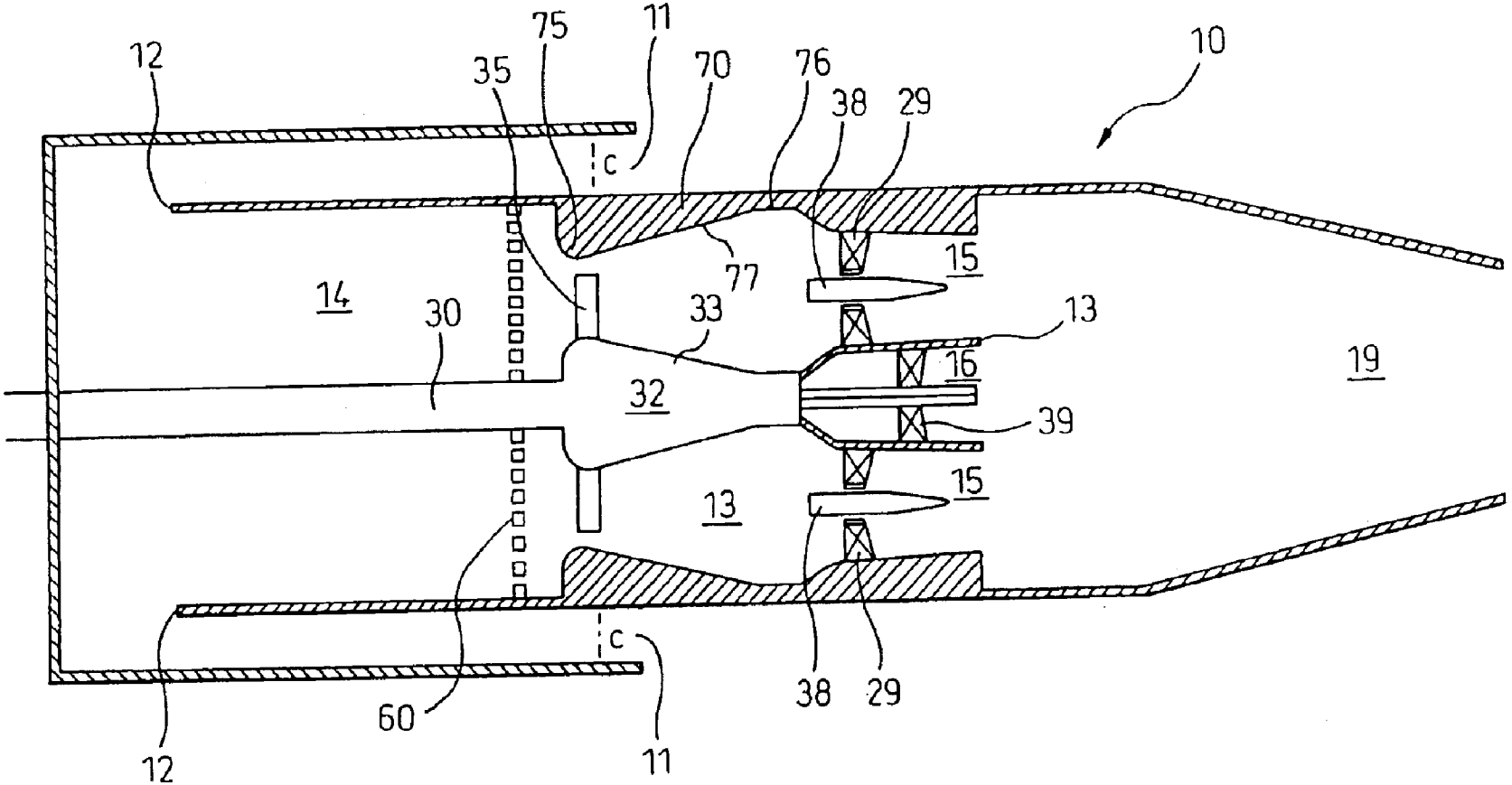
FIG. 12 is a longitudinal partially sectional view of a combustor according to a further embodiment of the present invention.
Figure 13:
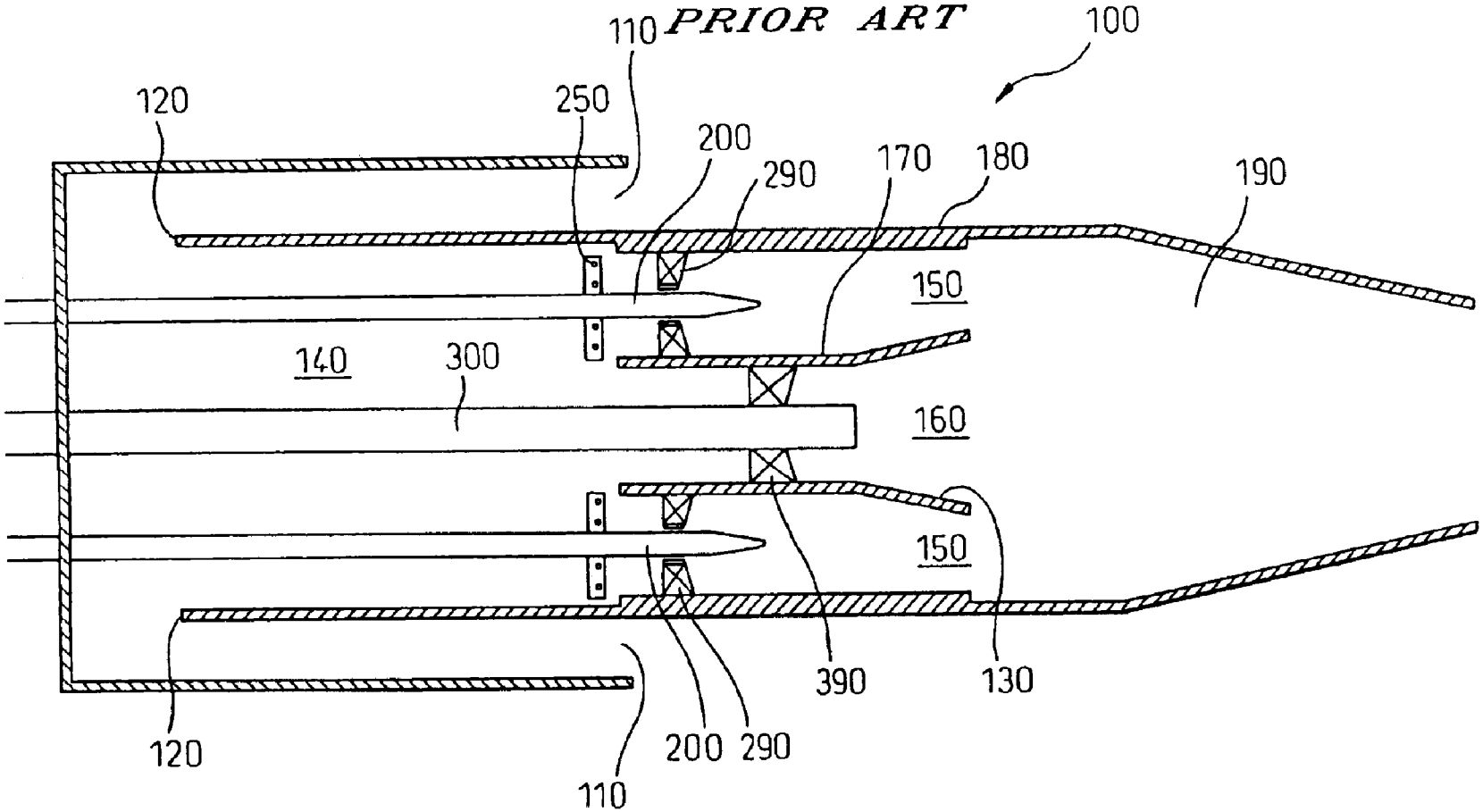
Fig. 13 PRIOR ART
FIG. 13 is a longitudinal sectional view of a combustor containing a known fuel nozzle.

As a matter of course, in the embodiments shown in FIG. 6 and FIG. 9, the installation of the turbulence producing body, for example, the porous plate, in the air passage is included within the scope of the present invention. For example, FIG. 11 depicts the embodiment of FIG. 6 with porous plate 60 provided in the air passage. Additionally FIG. 12 depicts the embodiment of FIG. 9 with porous plate 60 provided in the air passage.

In the first embodiment of the present invention, the turbulence producing body produces the turbulence of air and, thus the air can be mixed with the fuel while the turbulence of air is maintained. Therefore, a common effect, that the mixing action of air and fuel can be enhanced in the radial direction, can be obtained. The turbulence producing body also functions as the pressure losing body. Therefore, a common effect that the velocity fluctuation in the combustion vibration can be absorbed by producing the flow resistance, can be obtained.

LIST OF REFERENCE NUMERALS

10 . . . combustor
11 . . . inlet
12 . . . inner tube end portion
13 . . . annular chamber
14 . . . air passage
15 . . . mixing chamber
16 . . . pilot combustion chamber
17 . . . pre-mixing nozzle
18 . . . inner tube
20 . . . fuel nozzle
22 . . . projection
23 . . . inclined portion
25 . . . hollow column
26 . . . injection port
29 . . . swirler
30 . . . pilot nozzle
32 . . . projection
33 . . . inclined portion
35 . . . hollow column
36 . . . injection port
60 . . . porous plate
61 . . . hole
70 . . . diffuzer portion
75 . . . narrow portion
76 . . . wide portion
77 . . . inclined portion

What is claimed is:

1. A gas turbine combustor comprising an air passage to supply air to the inside; and a fuel nozzle which is provided with an injection port to inject fuel and is disposed in the air passage, wherein a turbulence producing means is provided in the air passage to produce a turbulence in the vicinity of the injection port of the fuel nozzle, wherein a diffuser portion is provided, as the turbulence producing means, in the air passage on the upstream side of the injection port in the direction of the airflow, and further comprising a pilot nozzle to supply pilot fuel, wherein the diffuser portion is an annular diffuser portion defined by an inner wall of the air passage and an outer wall of the pilot nozzle.

2. A gas turbine combustor according to claim 1, wherein the turbulence producing means is adjacent to the injection port of the fuel nozzle.

3. A gas turbine combustor according to claim 1 or 2, wherein a porous plate provided with a plurality of holes is further provided, as the turbulence producing means, on an upstream side of the injection port in the direction of the airflow.

4. A gas turbine combustor according to claim 3, wherein the hole is shaped like a circle.

5. A gas turbine combustor according to claim 3, wherein the hole is shaped like a rectangle.

6. A gas turbine combustor according to claim 3, wherein the hole extends in a radial direction of the porous plate.

7. A gas turbine combustor according to claim 3, wherein the hole extends in a circumferential direction of the porous plate.

8. A gas turbine combustor according to claim 1, wherein the diffuser portion causes the cross-sectional area of a part of the air passage positioned in the vicinity of the injection port to be smaller than that of a downstream portion of the air passage positioned downstream of the injection port in the direction of the airflow.

9. A gas turbine combustor according to claim 8, wherein a porous plate provided with a plurality of holes is further provided, as the turbulence producing means, on an upstream side of the injection port in the direction of the airflow.

10. A gas turbine combustor according to claim 9, wherein the hole is shaped like a circle.

11. A gas turbine combustor according to claim 9, wherein the hole is shaped like a rectangle.

12. A gas turbine combustor according to claim 9, wherein the hole extends in a radial direction of the porous plate.

13. A gas turbine combustor according to claim 9, wherein the hole extends in a circumferential direction of the porous plate.

14. A gas turbine combustor comprising an air passage to supply air to the inside; and a fuel nozzle which is provided with an injection port to inject fuel and is disposed in the air passage, wherein a turbulence producing means is provided in the air passage to produce a turbulence in the vicinity of the injection port of the fuel nozzle, wherein the turbulence producing means comprises a porous plate provided with a plurality of holes, the porous plate being provided on an upstream side of the injection port in the direction of the airflow, and wherein the turbulence producing means further comprises a diffuser portion provided in the air passage on the upstream side of the injection port in the direction of the airflow.

* * * * *

UNITED STATES PATENT AND TRADEMARK OFFICE

CERTIFICATE OF CORRECTION

PATENT NO. : 6,880,340 B2
DATED : April 19, 2005
INVENTOR(S) : Keijiro Saitoh

It is certified that error appears in the above-identified patent and that said Letters Patent is hereby corrected as shown below:

Title page,
Item [30], should read:
-- [30] Foreign Application Priority Data
Jun. 7, 2001 (JP)……..2001-173005 --.

Signed and Sealed this

Third Day of January, 2006

JON W. DUDAS
*Director of the United States Patent and Trademark Office*